US006105858A

United States Patent [19]

Chien

[11] Patent Number: 6,105,858

[45] Date of Patent: Aug. 22, 2000

[54] INNER CASE WITH LID OF A CASH BOX

[76] Inventor: Te-Hsin Chien, No. 1, Lane 160, Pei-Ne stree, Shu Lin Chen, Taipei Hsien, Taiwan

[21] Appl. No.: 08/778,027

[22] Filed: Dec. 31, 1996

[51] Int. Cl.[7] ..... B65D 91/00

[52] U.S. Cl. ..... 232/1 D; 232/15; 235/22; 235/7 R; 292/166; 312/291

[58] Field of Search ..... 232/1 D, 15, 43.2; 235/22, 7 R, 10; 292/166; 312/291, 319.1; 206/83, 84, 560, 561, 565

[56] References Cited

U.S. PATENT DOCUMENTS

| | | | |
|---|---|---|---|
| 2,497,624 | 2/1950 | Nelson | 262/166 |
| 3,494,650 | 2/1970 | Slopa | 292/166 X |
| 3,892,309 | 7/1975 | Coffey et al. | 235/22 X |
| 4,508,377 | 4/1985 | Takasaki | 295/166 |
| 4,786,785 | 11/1988 | Felt | 235/7 R |
| 4,804,824 | 2/1989 | Saguchi | 206/83 X |
| 5,451,753 | 9/1995 | Leatherwood et al. | 235/7 R |

FOREIGN PATENT DOCUMENTS

| | | | |
|---|---|---|---|
| 792831 | 1/1936 | France | 206/83 |
| 1287282 | 8/1972 | United Kingdom | 206/83 |

*Primary Examiner*—Blair Johnson

*Attorney, Agent, or Firm*—Pro-Techtor International Services

[57] ABSTRACT

The present invention relates to an inner case with lid for a cash box, comprising: a casing, formed as a rectangular box, which is open on the upper side, with some insertion openings on the back side, a horizontal groove above the insertion holes, and at least one hole in the front side; several bill holders, placed in the casing and having extensions that are insered into the insertion holes; a lid for covering the casing with the back edge of the lid being inserted in the groove of the casing; and at least one lock, attached on the lid, facing one of the holes on the front side of the casing and used to fix the lid on the casing.

10 Claims, 11 Drawing Sheets

INNER CASE WITH LID OF A CASH BOX

BACKGROUND OF THE INVENTION

1. Field of the Invention

The present invention relates to an inner case with lid for a cash box, particularly to an inner case with lid for a cash box, which can be opened and locked conveniently.

2. Description of Related Art

Supermarkets in modern society often work in two or three shifts, collecting their revenues in one or several cash boxes. With every change of shifts, the inner case of each cash box, containing the cash, is replaced by another inner case, in order to count the revenues of the previous shift. A conventional inner case of a cash box has an opening on the upper side with no lid (as shown in FIG. 10). When the inner case is taken out, it has to be provisionally covered by a pasteboard or cloth and to be handled with care to keep the cash therein in its place.

Other conventional cash boxes have inner cases which are provided with a lid covering the opening on the upper side. Such an inner case has a horizontal groove, into which one edge of the lid is laid, when it is closed. On the front end of the lid, a lock is installed, which is operated by a key. When the lid covers the inner case, the lock blocks it from opening. In this state, the cash in the inner case will not mix up. Handling of such an inner case, however, is not convenient. First the cash has to be opened with a key, then the inner case is taken out, the lid of the inner case is closed by a key, and finally, on delivery, the inner case is opened again using a key. Moreover, when producing such an inner case, the horizontal grooves and holders that hold down paper money have to be worked separately, leading to high production costs.

SUMMARY OF THE INVENTION

The main object of the present invention is to provide an inner case with lid for use in a cash box, wherein the lid can be conveniently opened and closed.

A further object of the present invention is to provide an inner case with lid for use in a cash box, which has low production costs.

The present invention can be more fully understood by reference to the following description and accompanying drawings.

DETAILED DESCRIPTION OF THE PREFERRED EMBODIMENTS

As shown in all Figures, the present invention mainly comprises an inner case 1 and a lid 20, which covers the inner case 1 whenever needed, ensuring that cash inside the inner case 1 will not fall out.

Figure 1:
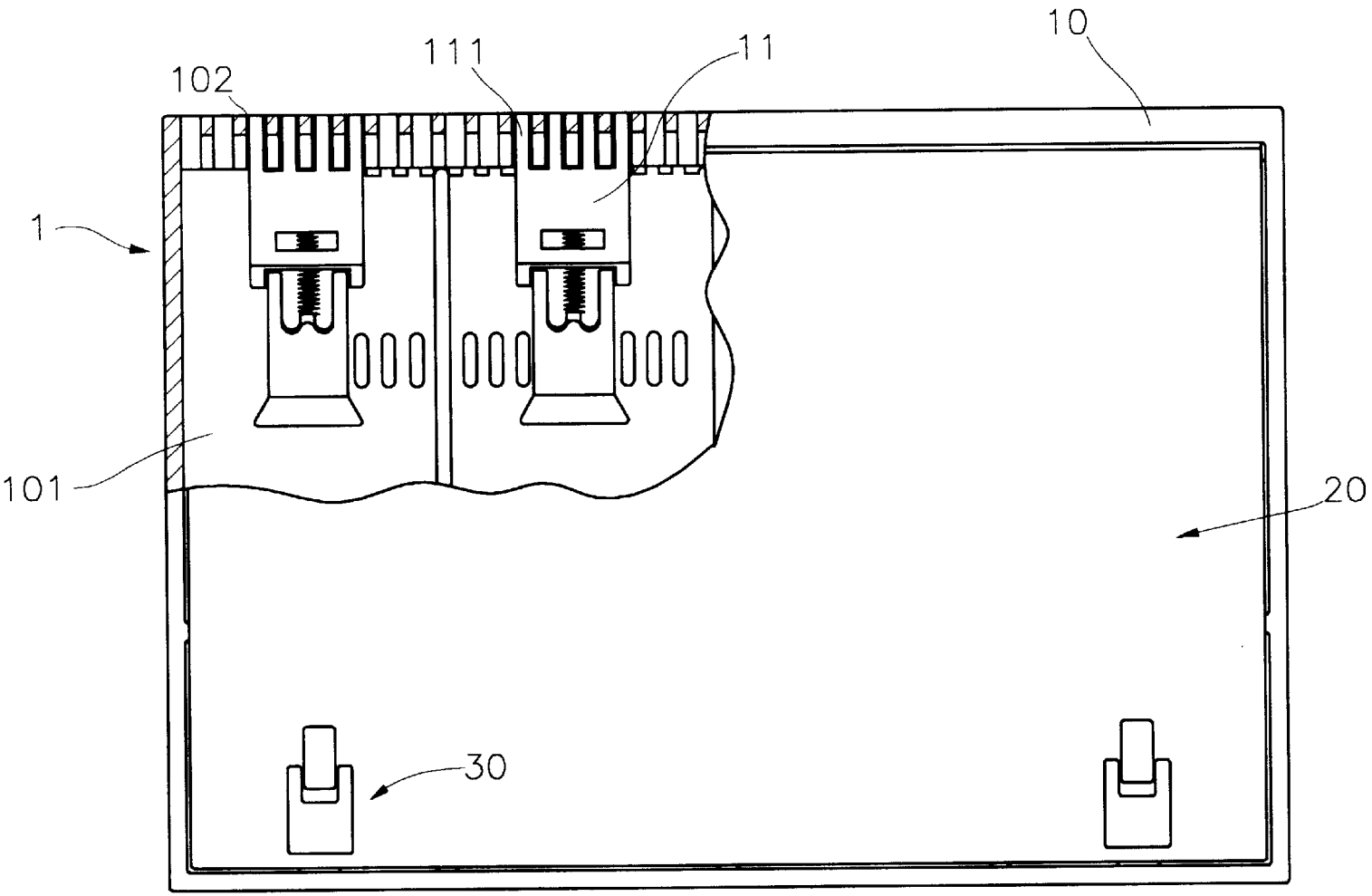
FIG. 1 is a plan view of the inner case with lid of the present invention, showing the position of the structural elements after closing the lid.
Figure 2:
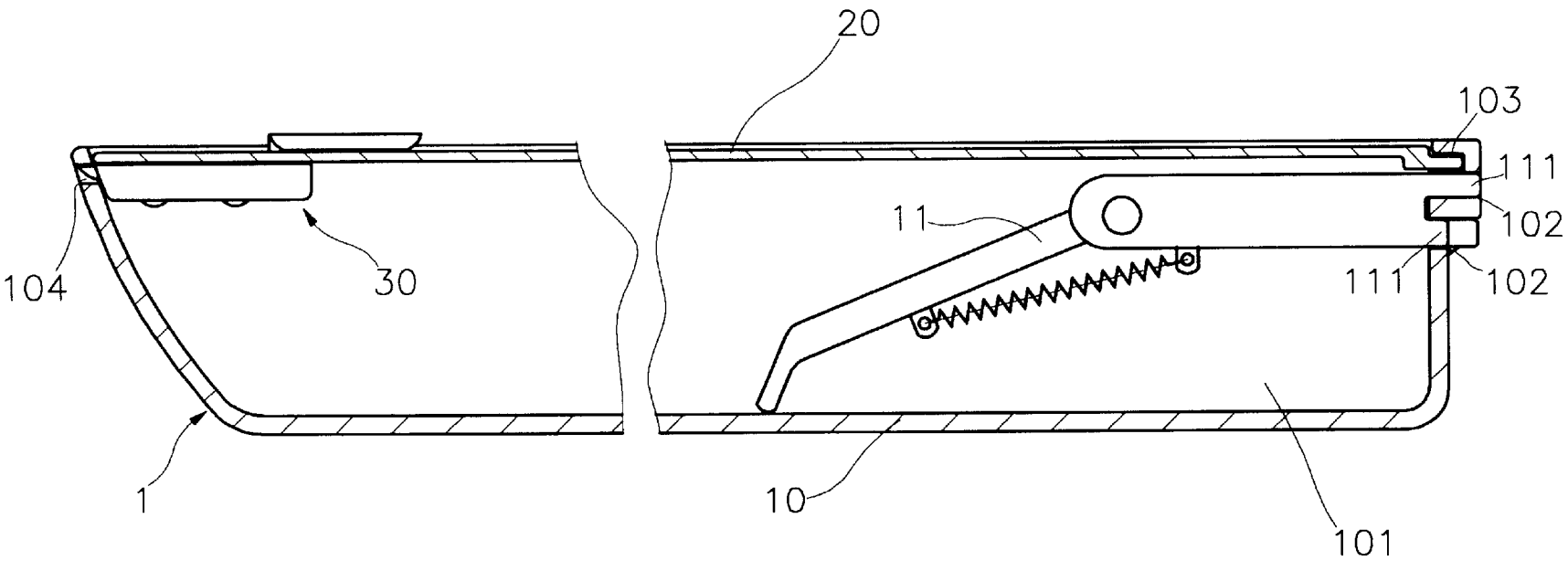
FIG. 2 is a side view of the present invention, showing the covering of the inner case by the lid.
Figure 3:
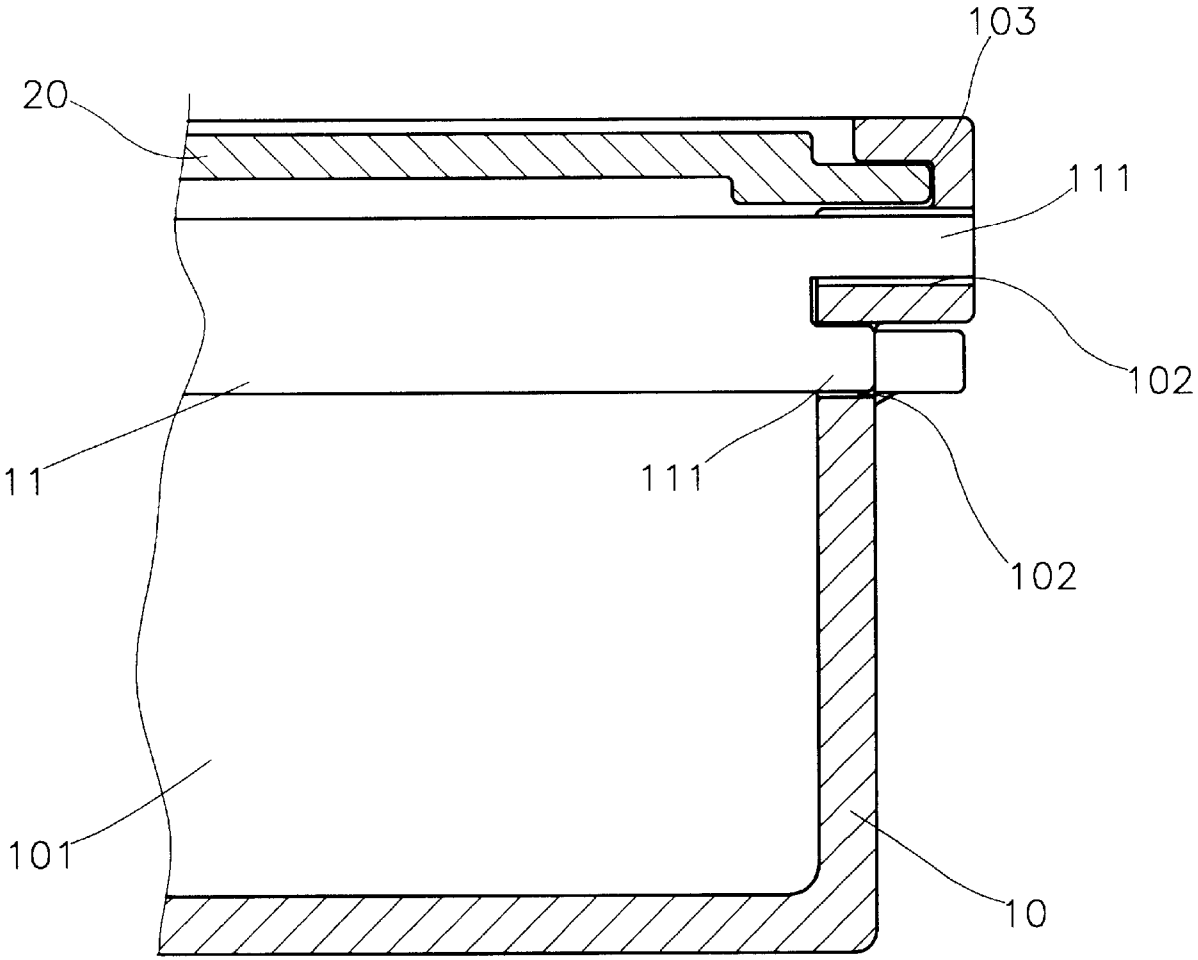
FIG. 3 is a partial sectional view of the back part of the present invention, showing the position of the structural elements.

Referring to FIGS. 1 and 3, the inner case 1 has a casing 10 and several bill holders 11. The casing 10 has a rectangular plan form and is divided into several compartments 101 for accommodating sorted bills. The casing 10 is open on the upper side. On the back side of the casing 10, close to the upper edge thereof, several horizontally equidistant insertion openings 102 are provided. The insertion openings 102 pass through the back side of from the casing 10 with walls that perpendicularly extend away from the back side of the casing 10, thus allowing to insert the holders for the bills 11 into the casing 10. The insertion openings 102 are arranged in pairs of upper and lower openings for stable positioning of the bill holders 11.

Each bill holder 11 has a joint, which connects a back part and a front part. The back part of each holder is connected to the back side of the casing 10. The front part is pressed on the bottom of one of the compartments 101 by a spring, so as to hold down bills. The back end of the back part of each bill holder 11 has several extensions 111, the position of which corresponds to the position of insertion openings 102. The extensions 111 of each bill holder 11 are stuck through the corresponding insertion openings 102 to fix the bill holder 11. The arrangement of the insertion openings 102 in pairs of upper and lower holes allows for stable positioning of the bill holders 11.

The back side of the casing 10 is further provided with a groove 103. The groove extends horizontally along the inner side of the back side of the casing 10 above the insertion openings 102. When the lid 20 is closed, the back edge of the lid 20 is inserted into the groove 103. The front side of the casing 10 has at least one hole 104, serving to block the front end of the lid 20 from opening and thus guarantee a stable position of the lid 20, when it is closed.

The lid 20 is formed as a rectangular plate, which covers the opening on the upper side of the casing 10. The width of the lid 20 is slightly less than the width of the casing 10, in order to allow the back edge of the lid 20 to enter the groove 103. Close to its front end the lid 20 has at least one hole 21, which passes through the lid 20 in a position corresponding to that of one hole 104. At each hole 21 a lock 30 is mounted, which in a blocking position sticks into one hole 104, securing a closed position of the lid 20.

Referring to FIGS. 4 to 7, each lock 30 mainly comprises a main body 31, a latch 32, a moving bar 33, and a control handle 34. The main body 31 of each lock 30 is mounted on the lower side of the lid 20 below one hole 21 in a position corresponding to that of one hole 104. The front end of each main body 31 is aligned with the front end of the lid 20.

For each lock 30, inside the main body 31, there are two cavities 311 and 312, with the first cavity 311 in front of the second cavity 312. The cavities 311, 312 have a rectangular longitudinal section and a rectangular cross-section. The interior of the first cavity 311 is connected to the outside at the front end of the main body 31 by a first gliding path 313. The first gliding path 313 is aligned with one hole 104 and has the same cross section. The first cavity 311 and the second cavity 312 are connected by a second gliding path 314, which is aligned with the first gliding path 313.

The latch 32 is an elongated body, which is glidingly inserted in the first gliding path 313. The front end of the latch is formed as a nose 321. When the latch 32 is in its most forward position, the nose 321 extends beyond the main body 31 and, by the positioning of the main body 31, fits into one of the holes 104. The tip of the nose 321 is close to the upper side thereof. Below the tip, the surface of the nose is inclined backwards, forming an inclined area 322. Thereby, when the front end of the lid 20 is vertically lowered on the casing 10 to close it, the nose 321 of the latch 32 is pushed back into the main body 31, allowing to close the lid 20 onto the casing 10, without manually having drawn back the latch 32 into the interior of the first gliding path 313.

Inside the latch 32, there is an elongated cavity 323. The length of the cavity 323 exceeds the length of the nose 321. A gliding path 324 between the cavity 323 and the back end of the latch 32 connects the cavity 323 with the outside of the latch 32. The cavity 323, the gliding path 324 and the second gliding path 314 are aligned and accommodate the front end of the moving bar 33.

Figure 4:
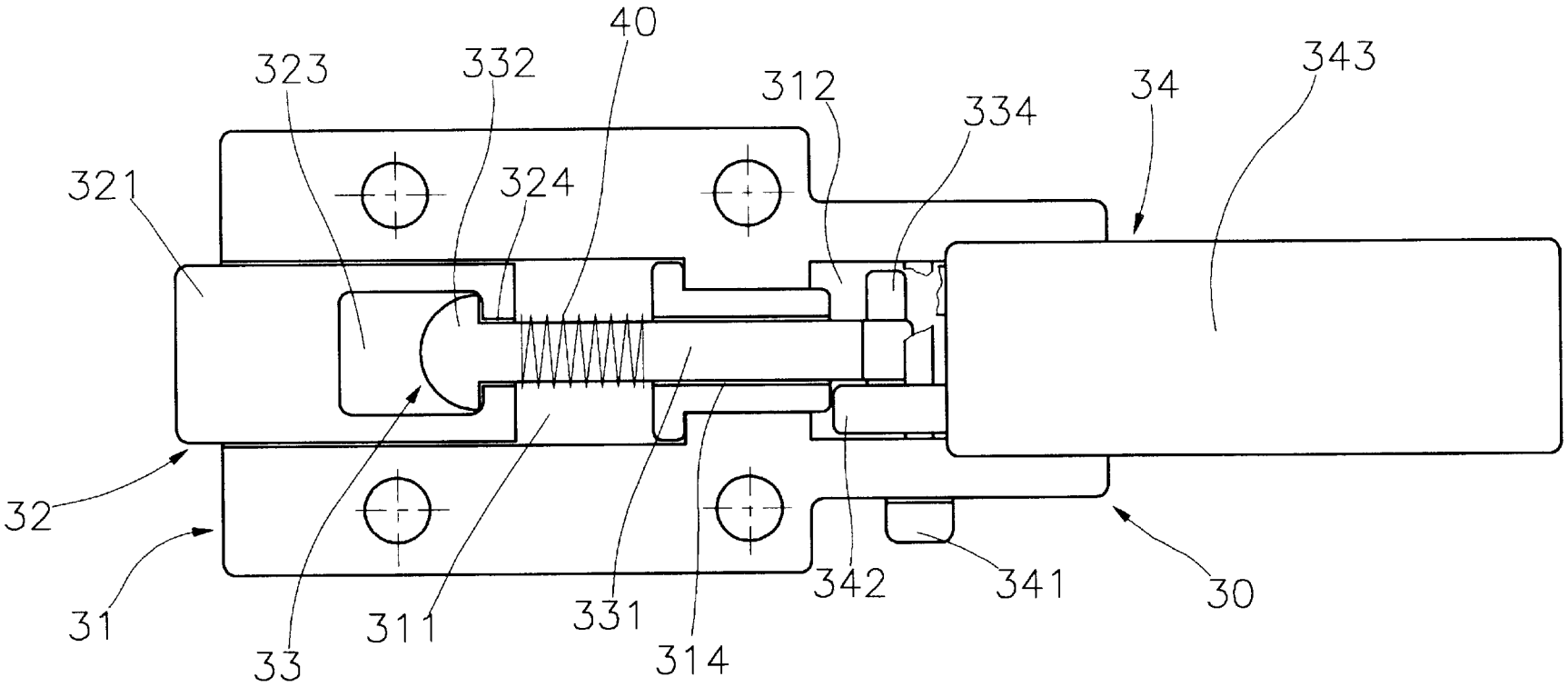
FIG. 4 is a plan view of the lock of the present invention.
Figure 5:
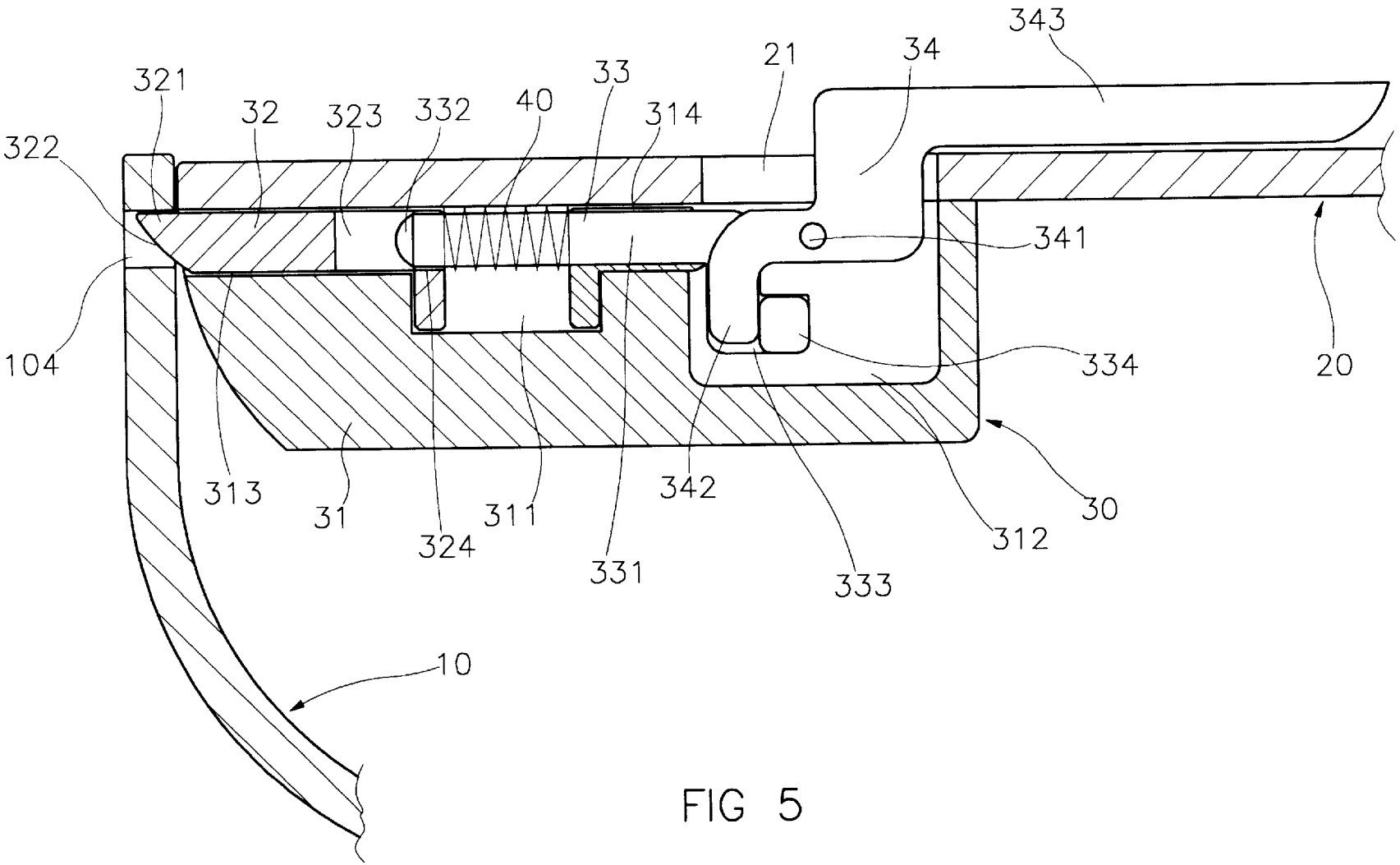
FIG. 5 is a sectional side view of the lock of the present invention, showing the closed state thereof.
Figure 6:
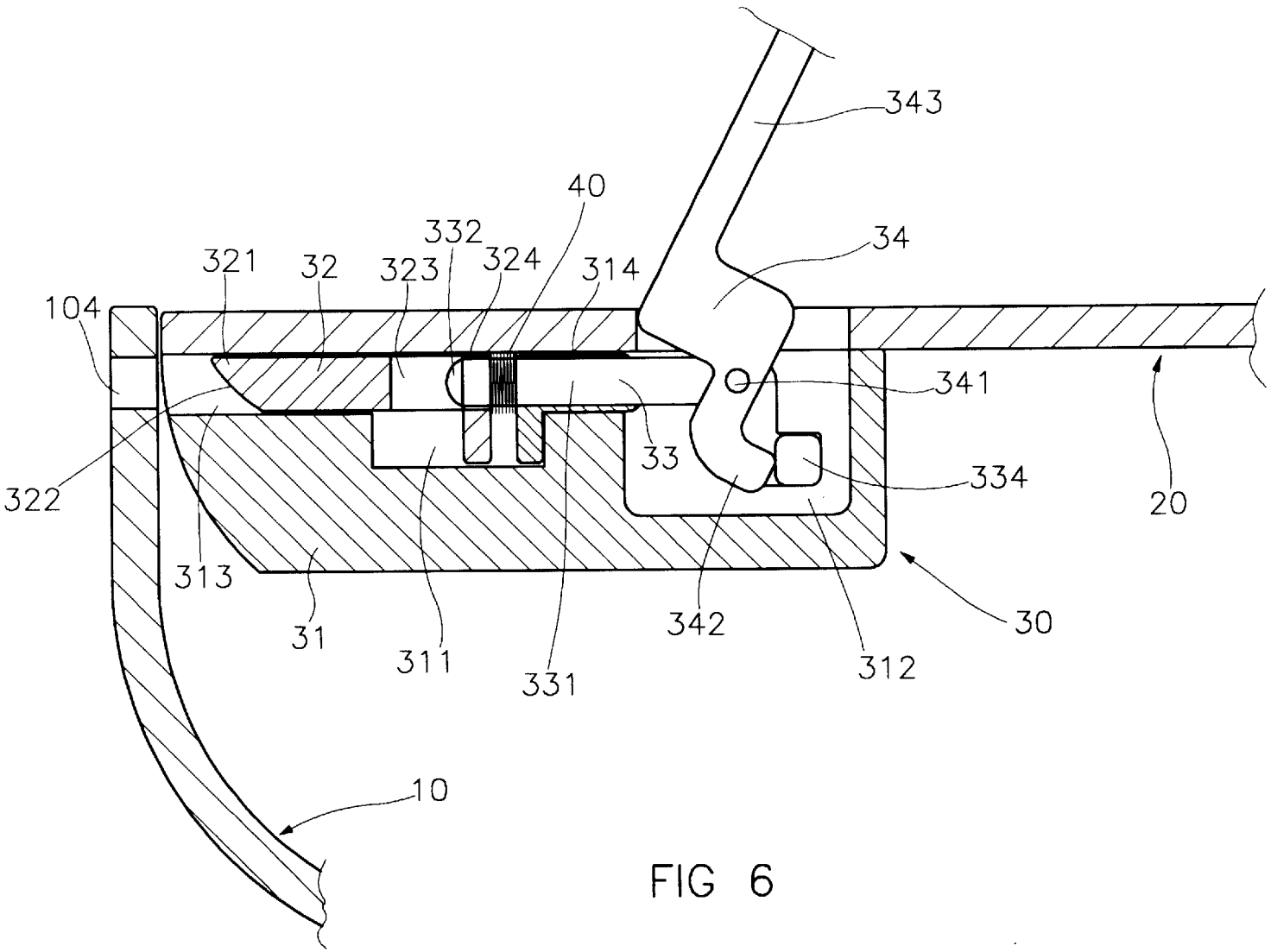
FIG. 6 is a sectional side view of the lock of the present invention, showing the opened state thereof.
Figure 7:
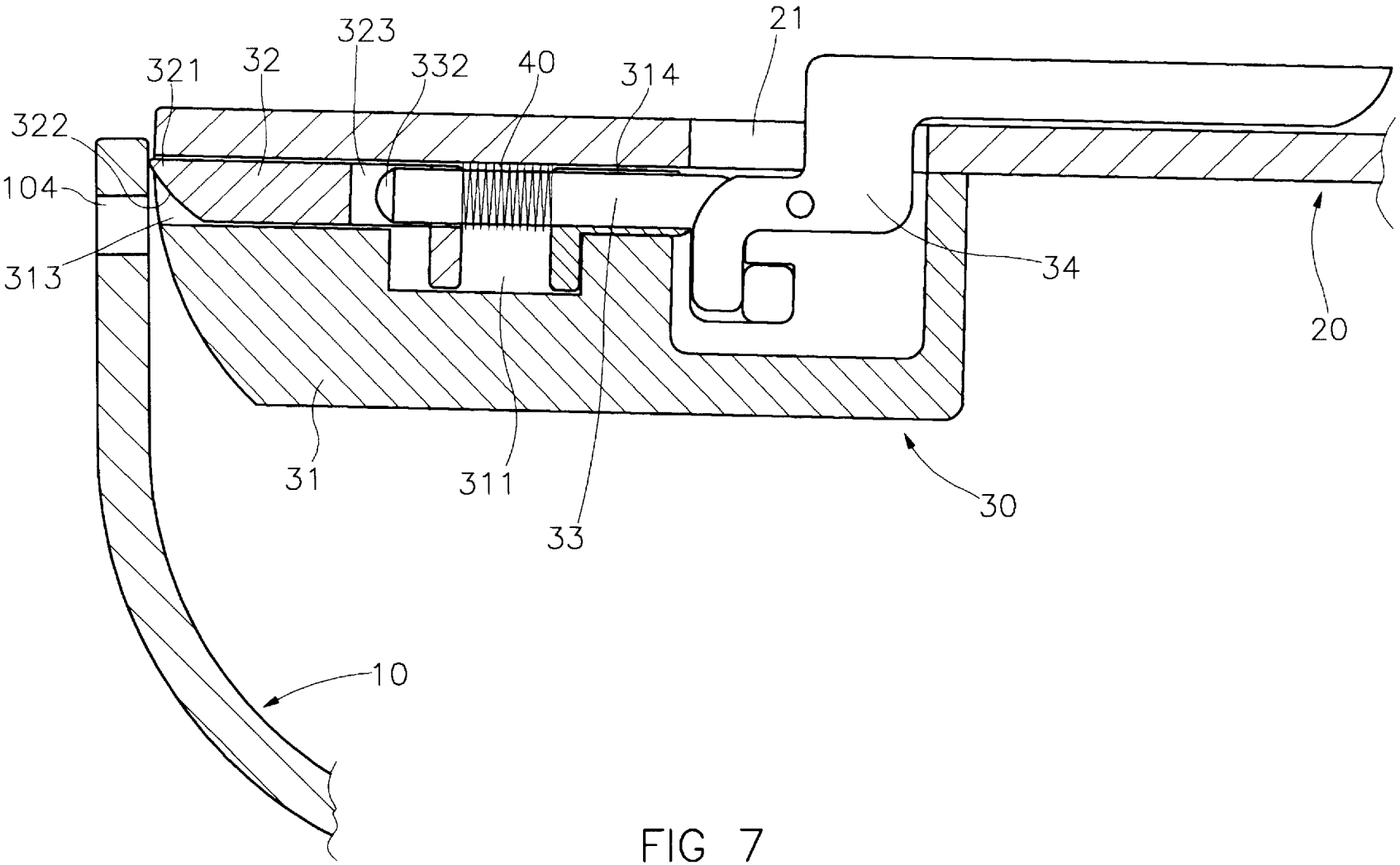
FIG. 7 is a schematic illustration, showing the closing movement of the lock, when the lid is closed on the inner case.

As shown in FIGS. 4 and 5, the moving bar 33 has the shape of the letter T, with a longitudinal part 331 and a head 332. The longitudinal part 331 is glidingly inserted in the gliding path 324 of the latch 32 and the second gliding path 314 of the main body 31. The head 332 is placed inside the cavity 323 of the latch 32 close to the back end of the cavity 323. Enough space is left between the head 332 and the front end of the cavity, for the head 332 not to block the backward movement of the latch 32, when the nose 321 is pushed back into the main body 31. The moving bar 33 on its back end further has a tail 333, which extends downwards. The end of the tail 33 is widened horizontally to two lateral projections 334, which are engaged by the control handle 34.

The control handle 34 is hingedly mounted on a shaft 341, which is installed between the two lateral sides of the second cavity 312 of the main body 31. Below the shaft 341, the control handle 34 has a claw 342. The claw 342 extends downwards, not interfering with the moving bar 33. The back side of the claw 342 leans against the front side of the lateral projections 334. Above the shaft 341, the control handle 34 has a handlebar 343, which passes through the hole 21 of the lid 20. In its lowest position, the handlebar 343 lies parallel to the lid 20. When the handlebar 343 is raised, the control handle 34 turns around the shaft 341, with the claw 342 pushing back the moving bar 33, the moving bar 33 in turn pulling back the latch 32. Thereby the nose 321 is drawn into the interior of main body 31, disengaging with the hole 104, such that the lid 20 can be opened.

The elongated part 331 of the moving bar 33 is in the section between the first gliding path 313 and the second gliding path 314 surrounded by a helical spring 40. The back end of the spring 40 leans against the back end of the first cavity 311, and the front end of the spring 40 leans against the back end of the latch 32. The spring 40 presses forward on the latch 32. When the handlebar 343 is raised and the moving bar 33 thereby pulled back, in turn pulling back the latch 32, the spring 40 is compressed. When the handlebar 343 is lowered again, the moving bar 33, and with it the latch 32, is no longer held back. Then the spring 40 pushes the latch 32 forward, such that the nose 321 protrudes from the main body 31.

Because of the arrangement of the casing 10, the lid 20 and the lock 30 with the inclined surface 322 of its gliding part, closing the lid 20 requires only a downward movement thereof, and opening the lid 20 requires only raising the handlebar 343. No key is needed, so the lid 20 can be conveniently closed and opened.

The insertion openings 102 extend horizontally, parallel to the cutting of the groove 103. So both insertion openings 102 and the groove 103 can be worked in one step, thus simplifying the working process and reducing production costs.

Figure 8:
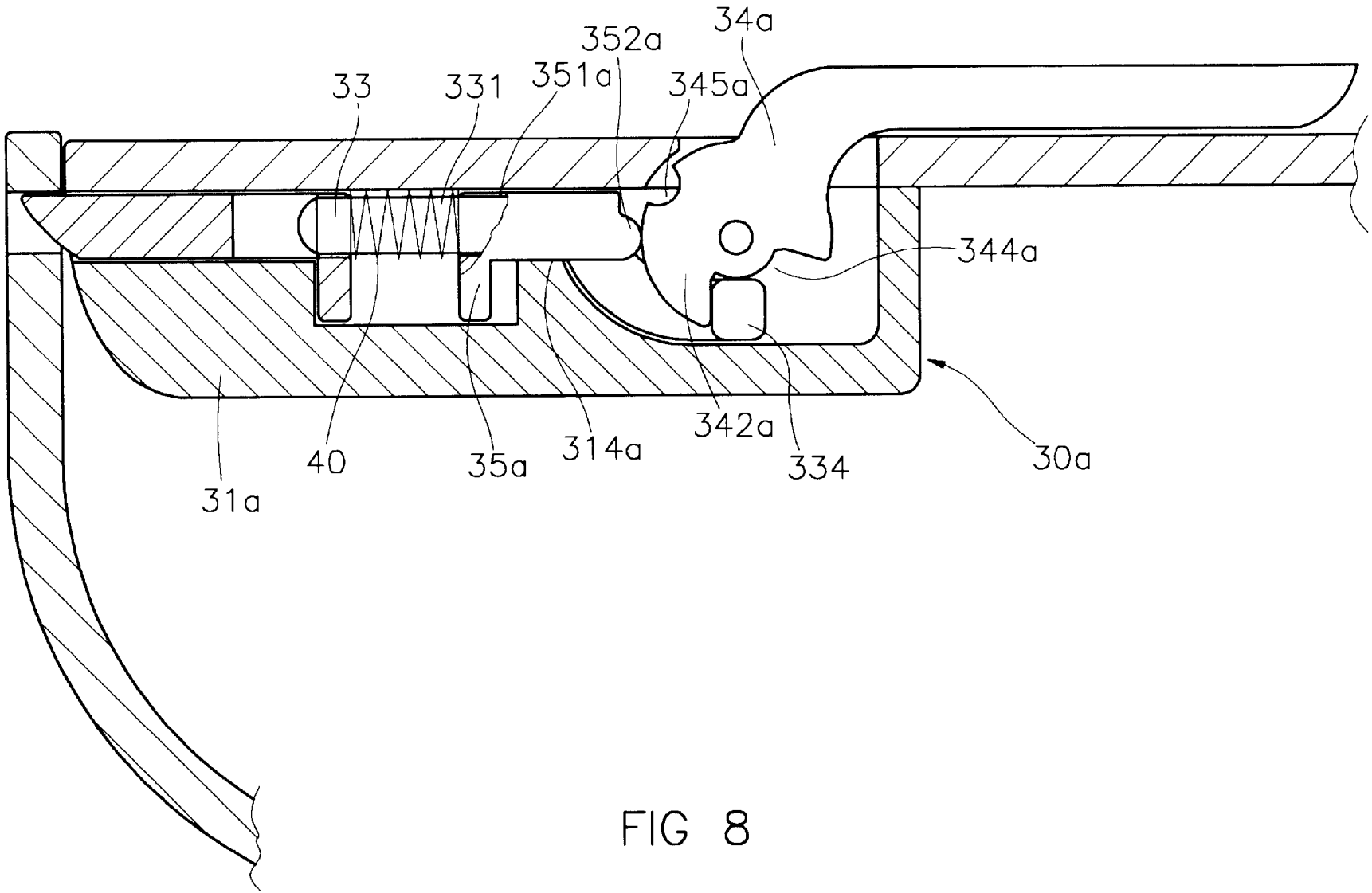
FIG. 8 is a sectional side view of the lock of the present invention in a second embodiment, showing the closed state thereof.
Figure 9:
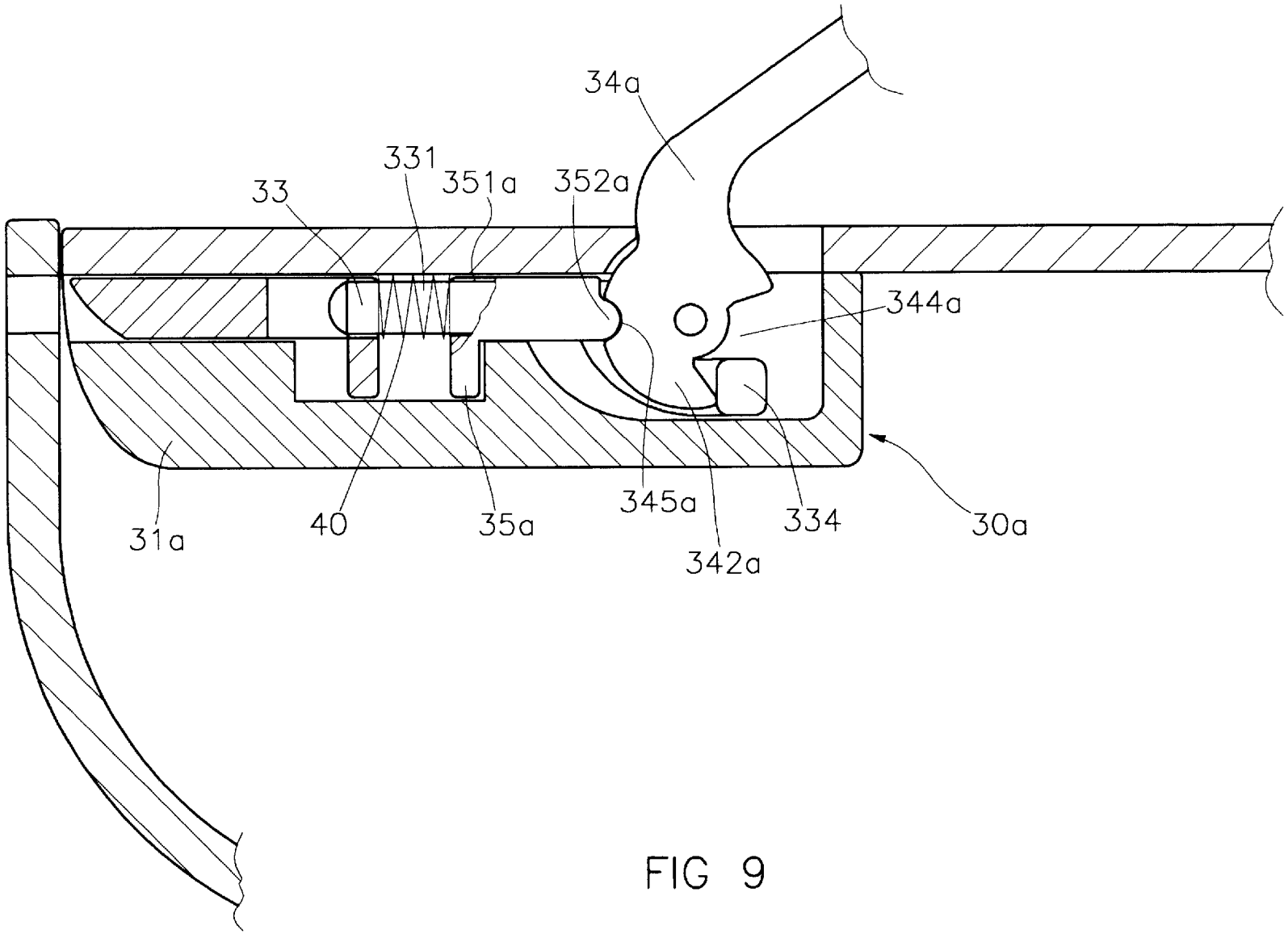
FIG. 9 is a sectional side view of the lock of the present invention in a second embodiment, showing the opened state thereof.
Figure 10:
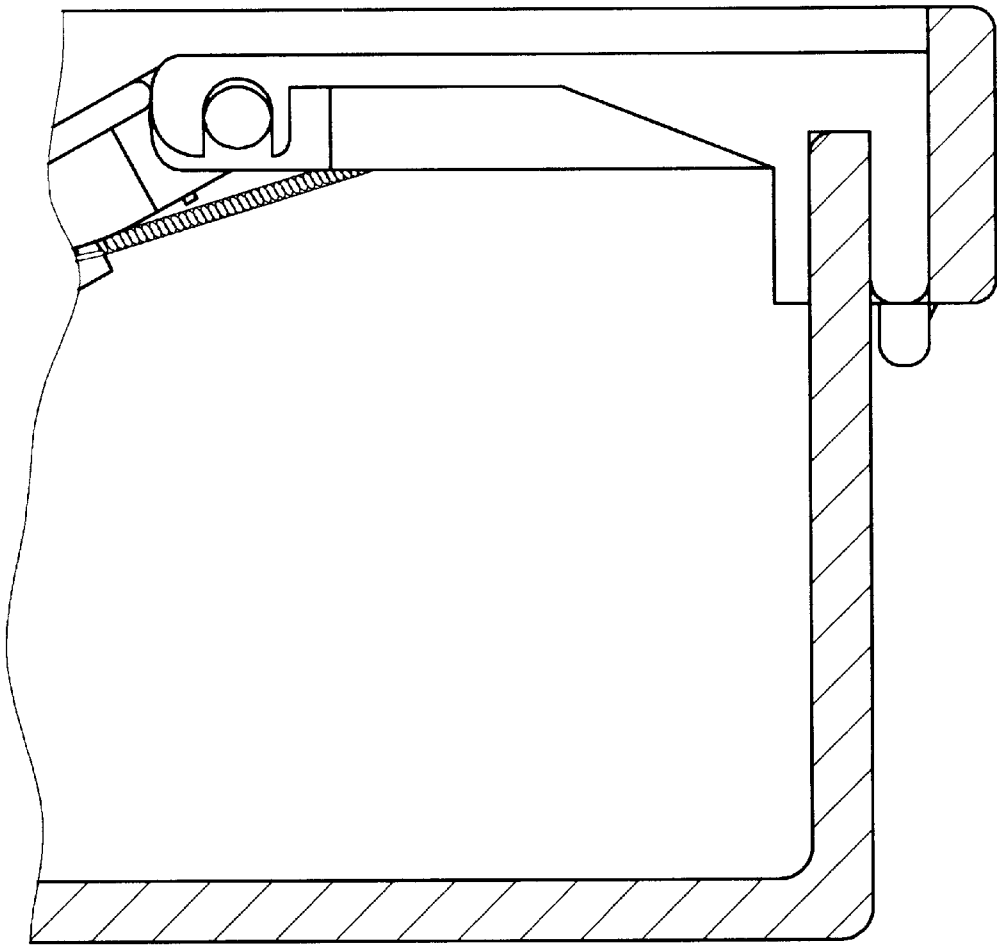
PRIOR ART FIG 10
FIG. 10 (prior art) is a sectional view of the back part of a conventional inner case for a cash box.
Figure 11:
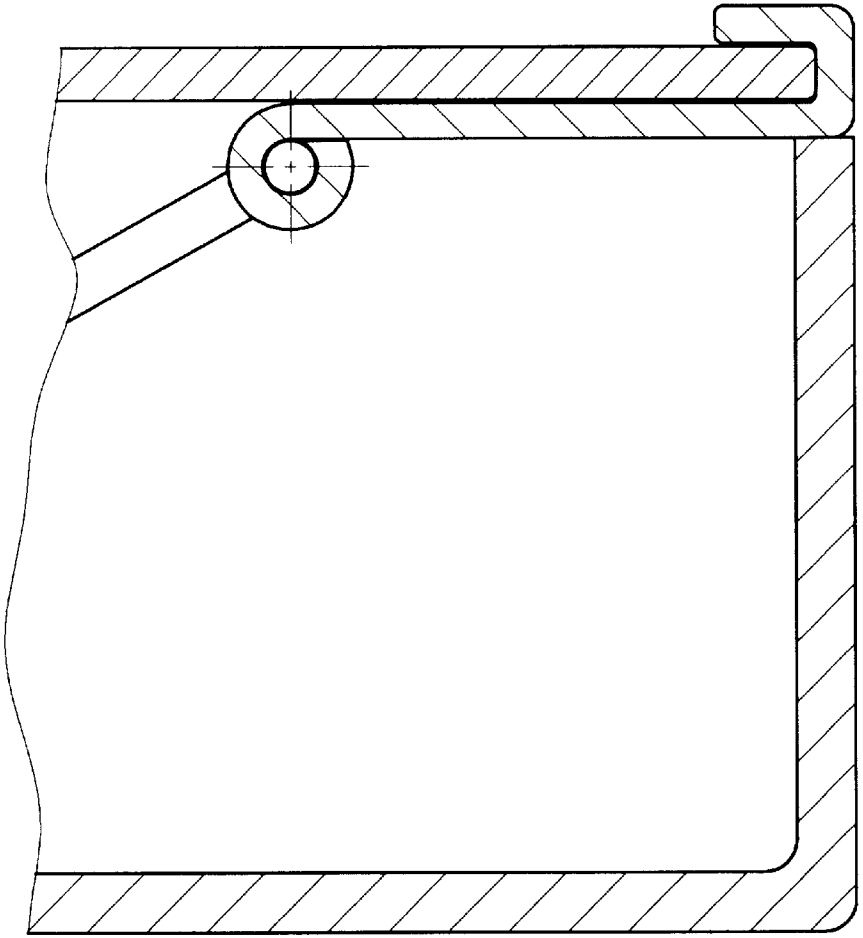
PRIOR ART FIG 11
FIG. 11 (prior art) is a sectional view of the back part of another conventional inner case for a cash box, having a groove for the lid.

As shown in FIGS. 8 and 9, the present invention in a second embodiment is provided with a modified lock 30*a*. The lock 30*a* has a main body 31*a* with a second gliding path 314*a* of a larger cross-section. A gliding support 35*a* is inserted in the second gliding path 314*a*. The front end and the back end of the gliding support 35*a* extend beyond the second gliding path 314*a*. The upper side of the gliding support 35*a* is formed as a gliding groove 351*a*, into which the elongated part 331 of the moving bar 33 is laid. The back end of the gliding support 35*a* has a projection 352*a*, which in longitudinal section is half-circular. To the back of the gliding support 35*a*, in the second cavity 312, a control handle 34*a* is mounted on the horizontal shaft 341*a*. The back end of the spring 40 leans against the front end of the gliding support 35*a*, such that the projection 352*a* is pressed against the control handle 34*a*.

The control handle 34*a* has a claw 342*a*. The claw 342*a* is in longitudinal section formed as a disk, which is concentric with the shaft 341. The claw 342*a* has a cut out sector 344*a* below the shaft 341 and a half-circular incision 345*a* in front of the shaft 341. The front end of the cut out sector 344*a* leans against the front end of the lateral projections 334. When the control handle 34*a* is turned, the moving bar 33 is pulled backwards, in turn pulling back the latch 32, thus allowing to open the lid 20. After turning the control handle 34*a* by a certain angle, the projection 352*a* of the gliding support 35*a* is by the elastic force of the spring 40 pushed into the incision 345*a*, fixing the lock 30*a* in an opening position. To bring the lock 30*a* into a closing position again, the control handle 34*a* is manually turned back.

What is claimed is:

1. An inner case with lid for a cash box, comprising:

a casing with a bottom side, front side, a back side with an inner surface, two lateral sides and an upper side, said upper side being open, said casing having a plurality of insertion openings passing through said back side spaced above said bottom side, said insertion openings having walls which are perpendicular to and extend away from said back side, said back side above said insertion openings having a horizontal slot which is open towards said inner surface, said casing on said front side having at least one hole;

a plurality of bill holders inside said casing, each said bill holder comprising a front part and a back part, wherein for each said bill holder said front part and said back part are connected by a joint, said back part having an extension which is inserted into one of said insertion openings;

a lid having a front end and a back end with a back edge, said lid removably covering said casing with said back edge fitting into said slot, said lid having at least one hole near said front end thereof; and at least one lock which is attached to said lid in a position that is next to one of said holes of said casing when said lid covers said casing, said lock having a closed state wherein said lock enters said hole of said casing, thereby blocking removal of said lid, and having an open state wherein said lock is removed from said hole of said casing, thereby allowing removal of said lid; and wherein said insertion openings are arranged in pairs of upper and lower insertion openings and wherein each of said bill holders has two extensions which are inserted into one of said pairs of upper and lower insertion openings, so as to provide for stable fixing of said bill holders.

2. The inner case with lid for a cash box according to claim 1, wherein said at least one lock comprises:

a main body with a front side, said main body having a first cavity with a back side and said main body having a second cavity, said first cavity lying in front of said second cavity, said first cavity and said front side of said main body being connected by a first gliding path, said first cavity and said second cavity being connected by a second gliding path;

a latch with a front end and a back side, said latch being glidingly inserted into said first gliding path with said front end of said latch in the foremost position thereof protruding from said front side of said main body;

a moving bar with a front end and a back end, said moving bar glidingly inserted into said second gliding path, with both said front end and said back end of said moving bar extending beyond said second gliding path, said front end of said moving bar being connected to said latch, such that said moving bar, when moved backwards, takes said latch therewith, and said back end being bent downwards and having two lateral projections on opposing sides;

a control handle which is hingedly mounted in said second cavity on a shaft, said shaft being placed above said two lateral projections, said control handle having a claw with a back side which leans against said two lateral projections, such that when said control handle is turned to shift back said claw, said moving bar is pulled back; and a helical spring with a front end and a back end, said helical spring surrounding said moving bar, said front end of said helical spring leaning against said back side of said latch and said back end of said helical spring leaning against said back side of said first cavity, said helical spring pressing said latch forward;

wherein said moving bar, when pulled backwards, in turn pulls said latch backwards, such that said front end of said latch vanishes inside said first gliding path, leaving said lock in an open state, and wherein said latch, when said moving bar is released, is pushed forward by said helical spring, such that said front end of said latch extends beyond said front end of said main body, leaving said lock in a closed state.

3. The inner case with lid for a cash box according to claim 2, wherein said front end of said latch has a tip and a surface below said tip which is inclined downward and backward such that, when said front end of said latch is lowered onto an object, said latch is pushed back into said first gliding path.

4. The inner case with lid for a cash box according to claim 2, wherein said latch has a cavity which has an elongated form and a back side and is connected to said back side of said latch by a gliding path, which in turn is aligned with said second gliding path of said main body, said front end of said moving bar being placed inside said cavity of said latch, leaning against said back side thereof.

5. The inner case with lid for a cash box according to claim 4, wherein said latch is movable backwards into said main body, without interfering with said moving bar.

6. The inner case with lid for cash box according to claim 2, wherein a gliding supports having a back end, is inserted into said second gliding path, so as to fix said lock in an open state.

7. The inner case with lid for a cash box according to claim 6, wherein said gliding support has a gliding groove with an open upper sides in which said moving bar is glidingly laid.

8. The inner case with lid for a cash box according to claim 6, wherein said gliding support on the back end has a projection, so as to fix said lock in an open state.

9. The inner case with lid for a cash box according to claim 8, wherein said control handle has a recess, into which said projection of said gliding support fits, so as to fix said lock in an open state.

10. The inner case with lid for a cash box according to claim 2, wherein said control handle has a handlebar above said shaft.

* * * * *